United States Patent [19]

Thomas

[11] 4,031,648

[45] June 28, 1977

[54] MAGAZINE SAFETY AND EJECTOR

[76] Inventor: Frank S. Thomas, 835 S. Cajon, West Covina, Calif. 91790

[22] Filed: Dec. 29, 1975

[21] Appl. No.: 644,437

[52] U.S. Cl. ..... 42/70 A; 89/137; 89/147

[51] Int. Cl.[2] ..... F41C 17/08

[58] Field of Search ..... 42/70 A; 89/147, 144, 89/148, 150, 154, 137

[56] References Cited

UNITED STATES PATENTS

| | | | |
|---|---|---|---|
| 1,024,932 | 4/1912 | Vander Haeghen | 42/70 A |
| 1,143,470 | 6/1915 | Whiting | 89/137 |
| 1,183,115 | 5/1916 | Reising | 89/137 |
| 1,234,961 | 7/1917 | Tansley | 89/137 |
| 1,418,021 | 5/1922 | Reifgraber | 89/147 |
| 1,638,068 | 8/1927 | Tansley | 42/70 A |
| 1,866,202 | 7/1932 | Floyd | 42/70 A |
| 3,857,325 | 12/1974 | Thomas | 89/147 |

*Primary Examiner*—Charles T. Jordan

[57] ABSTRACT

In a semi-automatic, magazine-loaded double action firearm wherein the firing pin is cocked and released for firing by a trigger bar articulated to the trigger, a resiliently mounted arm is positioned within the frame of the weapon to intercept and eject the spent cartridge case after each firing. When the magazine is withdrawn from the weapon, the arm forces the trigger bar out of engagement with the firing pin sear, thereby preventing the inadvertent firing of a live cartridge which may have been left in the chamber.

9 Claims, 7 Drawing Figures

Fig. 4
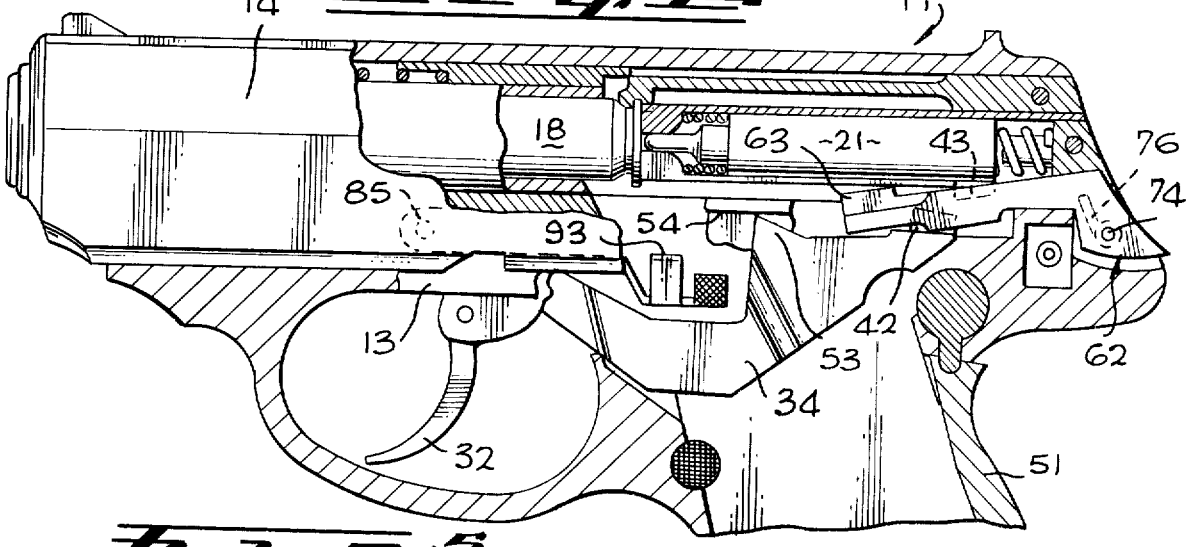
Fig. 5
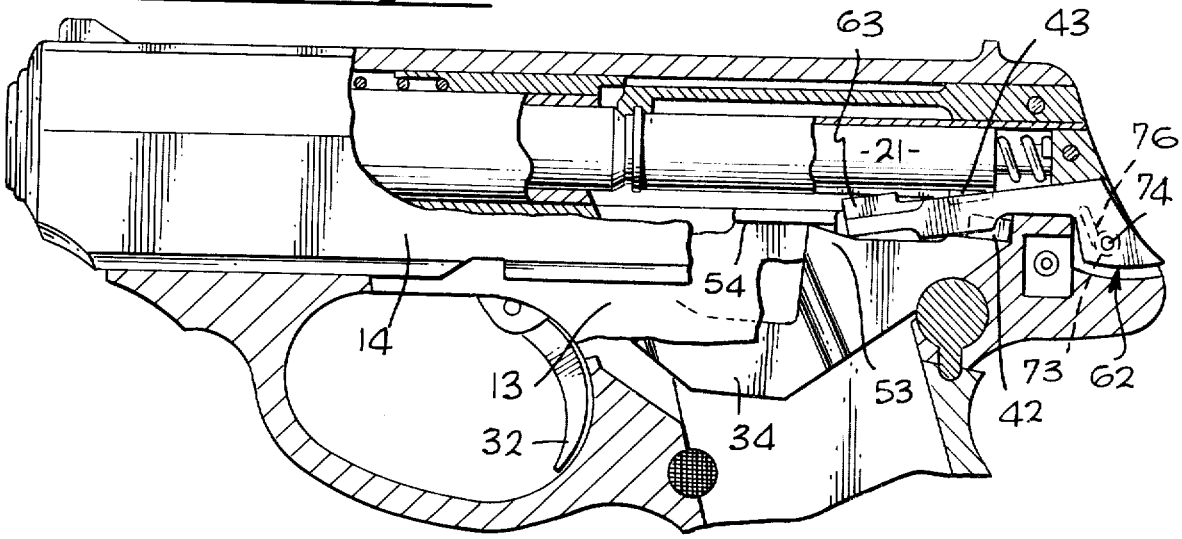
Fig. 6
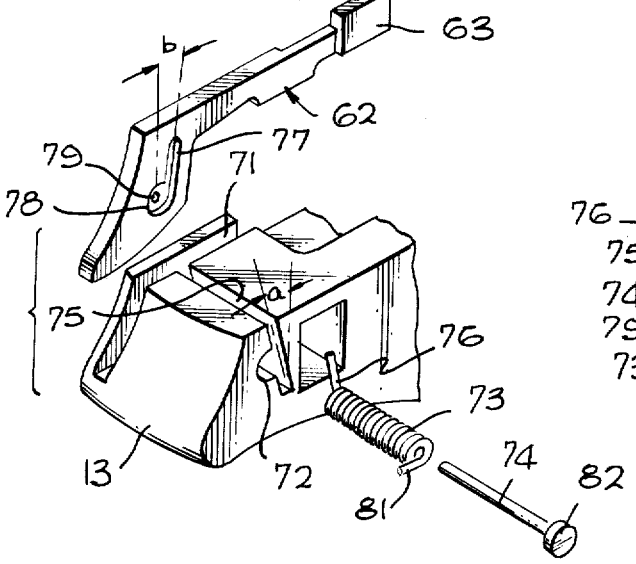
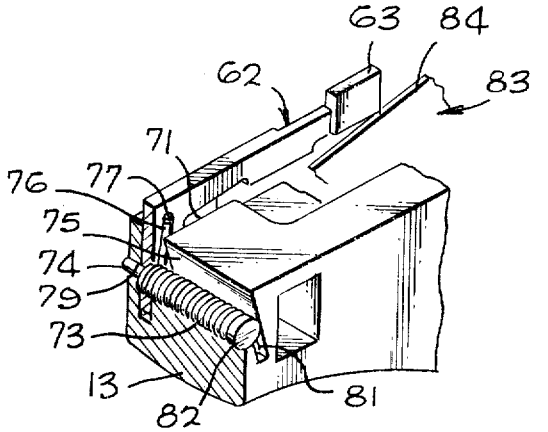
Fig. 7

MAGAZINE SAFETY AND EJECTOR

BACKGROUND OF THE INVENTION

1. Field of the Invention

This invention relates to firearms, and more particularly to hand-held or shouldered semi-automatic weapons of the double action type such as that described in my U.S. Pat. No. 3,857,325 wherein the firing pin is both cocked and released for firing by a trigger bar articulated to the trigger. Specifically it relates to magazine safeties and cartridge ejectors for such weapons.

It is well known to those familiar with conventional semi-automatic firearms that a live round left in the chamber after the magazine has been removed from its receiver poses a great danger to those who may handle or be exposed to the seemingly unloaded weapon. In the hands of the young, the inexperienced, the careless, a pull of the trigger may fire the "unhappy bullet" in whatever direction the weapon happens to be pointing. The newspapers bear repeated and tragic testimony to the seriousness of this deficiency.

One of the principal objects of the subject invention is the provision in a semi-automatic double action firearm of means to prevent the weapon from being fired accidentally or inadvertently after the magazine has been removed from the receiver. Since semi-automatic firearms constructed in accordance with my previously mentioned patent contain inherent safety features which prevent them from being fired unintentionally while the magazine is in the receiver, the incorporation of the subject invention in such firearms effectively provides a family of weapons which are substantially accident-proof and which are very nearly fool-proof.

Another object of this invention is the provision of an improved ejector for semi-automatic firearms. A further object is the combination of such an ejector with a magazine safety of the type previously described, in a single, compact, lightweight assembly which can be adapted for use in various configurations of my patented semi-automatic.

PRIOR ART

The prior art is replete with examples of attempts to construct or adapt semi-automatic magazine-loaded firearms to avoid or minimize the danger of accidental or inadvertent firing. These include, to mention only a few, a variety of buttons, levers and fasteners for locking the slide in open, closed or displaced positions; means for immobilizing, displacing or disengaging various components; and indicating devices intended to give visual warning of a dangerous or unsafe condition. Until the invention of my previously mentioned semi-automatic weapon, none of these had been wholly successful, and by and large most had proved to be unsatisfactory for one reason or another.

In my patented weapon I incorporated a magazine safety in the form of a resilient bar positioned to block rearward movement of the trigger bar when no magazine is in the receiver and to be displaced from the path of the trigger bar when a magazine is inserted in the receiver. While this mechanism performs well, I have concluded that its function can be better served by an alternative form of magazine safety.

SUMMARY OF THE INVENTION

The semi-automatic firearm disclosed in my aforementioned patent contains a resilient magazine safety bar positioned in the handle and mounted to block the rearward movement of the trigger bar. When the magazine is inserted into the magazine receiver it displaces the safety bar laterally out of alignment with the trigger bar, which is then free to move rearwardly when the trigger is pulled.

In the subject invention this passive safety bar is replaced by a positive-action safety mechanism in the form of a pivotable bar or similar caming means positioned adjacent the free end of the trigger bar and resiliently mounted to force the trigger bar out of registry with the firing pin sear. The trigger and trigger bar are thus free to move, but their movement has no effect on the firing pin.

The pivotable bar or cam is positioned to lie in the path of the magazine when the later is inserted into the magazine receiver and when so rotated allows the trigger bar to be rotated under the influence of the coiled trigger bar spring so that the trigger bar sear again registers with the firing pin sear. Then and only then can the weapon fire or be fired.

In its preferred embodiment the magazine safety and ejector of the subject invention comprises an elongated lever arm pivotally attached at its rear end to the frame of the weapon. The free forwardly extending end of the arm is urged downwardly against the trigger bar by a coil spring mounted on the pivot pin disposed transversely through the frame. The magazine bar is forced upwardly by one of the lips of the magazine when the magazine is inserted in its receiver. An enlargement on the free extremity of the magazine bar lies in the path of rearward movement of a cartridge in the firing chamber when the slide is moved rearwardly either manually or by recoil after firing, and in cooperation with the extractor serves to eject the cartridge through the ejection port in the slide.

The construction and operation of the preferred embodiment of the invention will be more fully understood, and other and further objects appreciated, from a reading of the following detailed description as illustrated by the accompanying drawings.

THE DRAWINGS

FIG. 4 is a fragmentary side elevation of the pistol illustrated in FIG. 1 with the magazine removed from its receiver;

FIG. 5 is a fragmentary side elevation of the pistol shown in FIG. 4 illustrating the operation of the magazine safety when the trigger is pulled while no magazine is in the weapon;

FIG. 6 is an exploded fragmentary perspective view of the rear portion of the frame of the pistol as shown in FIGS. 1–5 illustrating the method of mounting the magazine safety and ejector to the frame; and FIG. 7 is a fragmentary perspective view of the assembly shown in FIG. 6 with portions cut away to illustrate the construction and interaction of its several components.

Wherever practicable, a single numeral is used to depict identical or substantially similar components appearing in the several drawings.

DETAILED DESCRIPTION

Figure 1:
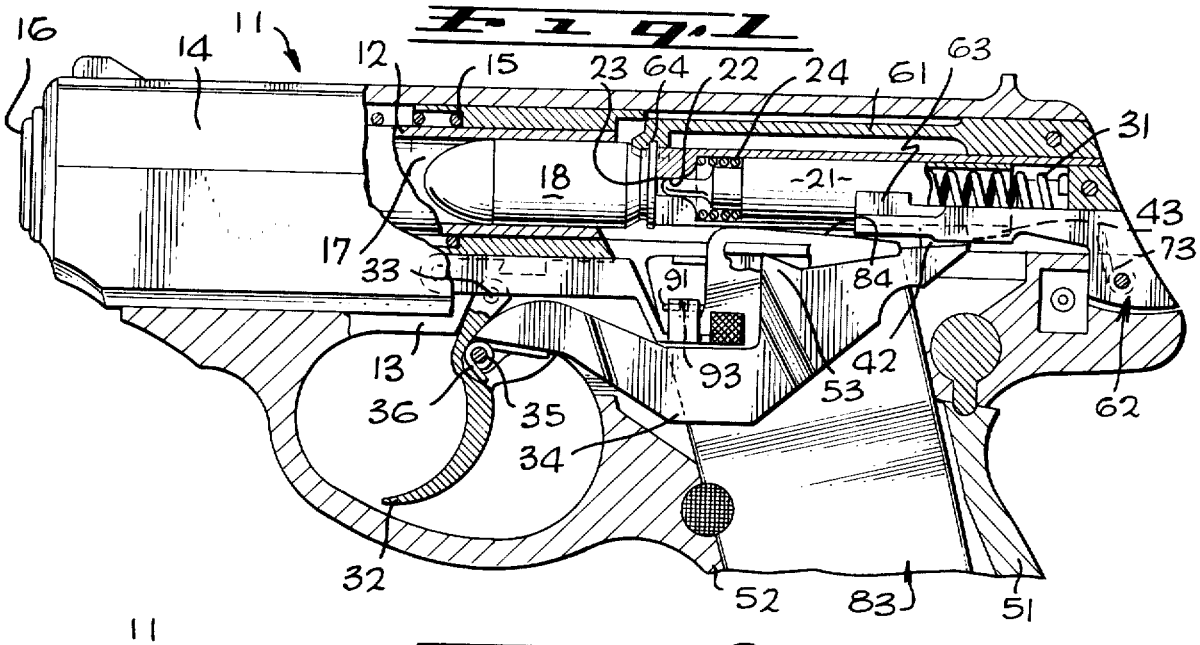
FIG. 1 is a fragmentary side elevation of a hand-held semi-automatic pistol embodying the subject invention with a magazine in its receiver, portions being cut away to reveal its internal construction.
Figure 2:
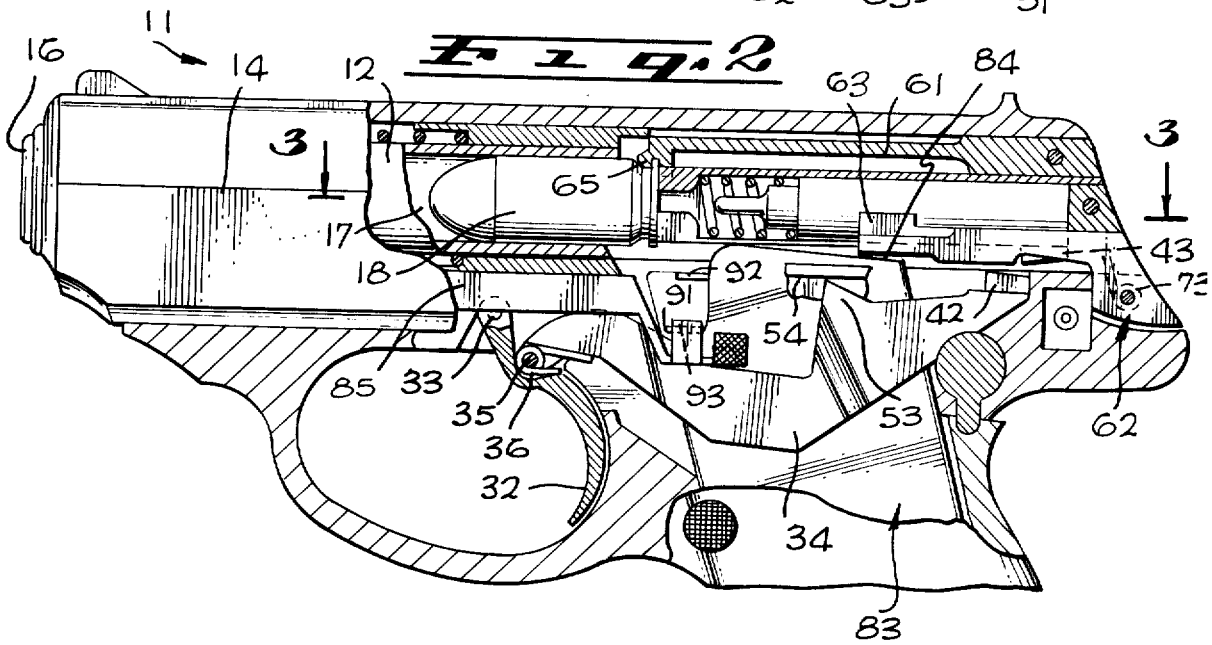
FIG. 2 is a fragmentary side elevation of the pistol of FIG. 1 illustrating the position and operation of certain of its components at the instant before firing.

Referring to FIGS. 1 and 2, the double action semi-automatic pistol 11 embodying the subject invention comprises a barrel 12 fixed to the frame 13 and a slide member 14 mounted on frame 13 to slide along the axis of barrel 12. A recoil spring 15 urges slide 14 toward the muzzle 16. Chamber 17 at the rear end of barrel 12 is adapted to receive a cartridge 18.

A hollow cylindrical firing pin 21 is slidably mounted for reciprocal motion within a cylindrical bore formed in the rear portion of slide 14 in axial alignment with barrel 12 and chamber 17. The tip of firing pin 21 strikes the primer of cartridge 18 through a bore 22 formed in the breech face 23.

A compression spring 24 positioned between the forward wall of bore 22 and an annular shoulder formed on the body of firing pin 21 urges the firing pin 21 rearwardly to maintain a safe spacing between the tip of firing pin 21 and the primer of cartridge 18.

A powerful compression spring 31 within and extending rearwardly of firing pin 21 is secured at its rear end to the rear end of slide 14.

Trigger 32 is pivotably mounted to frame 13 by means of trigger pin 33. A torsion spring (not shown) is mounted to trigger pin 33 and urges the trigger 32 forwardly of the weapon. A trigger bar 34 is pivotably secured to trigger 32 by means of pin 35. Resilient means, such as torsion spring 36 mounted to trigger bar pin 35 with one of its limbs secured to trigger 32 and the other extending under trigger bar 34 urge the free rear end of the trigger bar upwardly.

Figure 3:
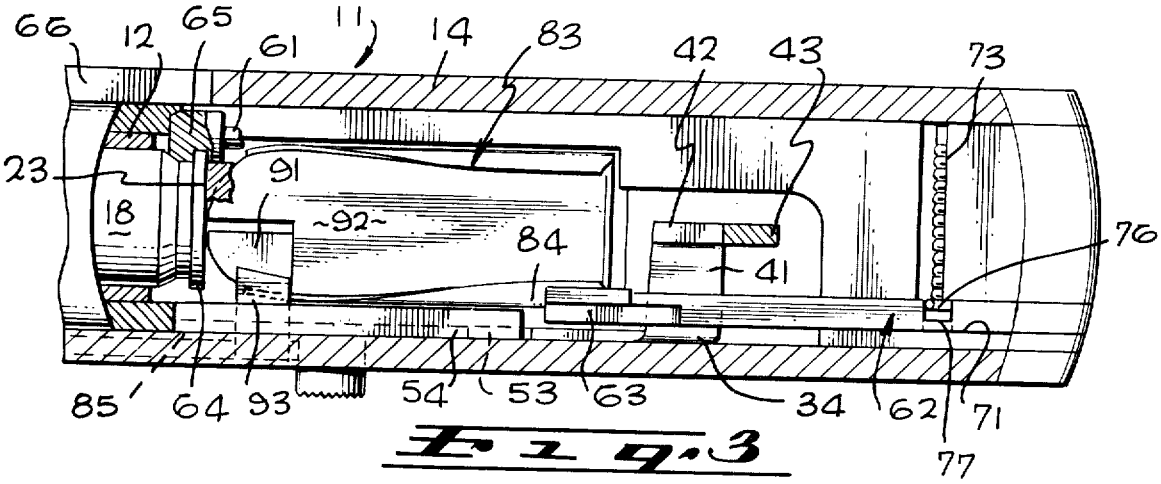
FIG. 3 is an enlarged fragmentary section taken along the line 3—3 of FIG. 2.

As shown most clearly in FIG. 3, the rear end of trigger bar 34 projects inwardly of slide member 14 to define a limb 41 on which is formed trigger bar sear 42. Trigger bar sear 42 is located laterally of slide 14 to register with firing pin sear 43 formed on the underside of firing pin 21.

A stirrup of bell crank 51 (only partially shown) is pivotably mounted at the rear of handle 52. As more fully described in my aforementioned U.S. Pat. No. 3,857,325, stirrup 51 serves to restrain the slide 14 against rearward motion when the trigger 32 is pulled, thereby allowing trigger bar 34 to force firing pin 21 rearwardly, compressing spring 31.

As trigger bar 34 moves rearwardly, a lobe 53 formed in its upper edge bears on a rail 54 formed on frame 13 and serves as a fulcrum causing the rear end of trigger bar 34 to rotate downwardly. At a predetermined position in its rearward travel, trigger bar sear 42 is disengaged from firing pin sear 43. As shown in FIG. 2 compressed spring 31 thrusts firing pin 21 forwardly causing its tip to strike and fire the primer of cartridge 18.

The recoil force within chamber 17 eventually exceeds the restraining force applied through stirrup 51 and slide 14 is thrust rearwardly on frame 13. Cartridge 18 is drawn rearwardly out of chamber by extractor 61, which is secured to the inner wall of slide 14.

The magazine safety and ejector 62 of the subject invention is pivotably mounted to the frame 13 with its enlarged head 63 in the path of the rim 64 of cartridge 18 as the spent cartridge is pulled rearwardly by extractor 61. When the rearwardly moving cartridge strikes ejector head 63, the recoil imparted to rim 64 causes the cartridge to pivot in the jaws 65 of extractor 61, which grasp rim 64 at a point on the opposite side of the cartridge from its point of impact with extractor 63, and ejects the casing from the weapon through port 66 in the side of slide 14.

Ejector 63 and extractor 61 cooperate in a similar manner to eject a live cartridge from the weapon when the slide 14 is operated manually.

FIGS. 6 and 7 most clearly illustrate the construction of the magazine safety and extractor assembly.

The magazine safety and extractor 62, here depicted as an elongated rigid generally L-shaped member is mounted for limited rotation in a recess 71 formed in the rear end of the frame 13. A bore 72 in frame 13 is sized to receive torsion spring 73 mounted on pin 74. A transverse slot 75 formed tangentially to bore 72 and at an angle *a* to an imaginary line perpendicular to the extended axis of barrel 12 of about 10° allows limb 76 of spring 73 to pass through frame 13 when spring 73 and pin 74 are inserted into bore 72.

A recess 77 is formed in the side of safety bar 62 at an angle *b* of about 10° to an imaginary line perpendicular to the major axis of bar 62 to receive limb 76 of spring 73. Bores 78 and 79 through bar 62 and frame 13, respectively, are sized to accept pin 74.

When the weapon is assembled, bar 62 is positioned in recess 71 with its forward end 63 elevated to align recess 77 and slot 75. Spring 73 is mounted on pin 74 and inserted through bore 72 to seat limb 76 in recess 77. Limb 81 at the opposite end of spring 73 is rotated around pin 74 to apply tension to spring 73 and is then inserted into slot 75. Pin 74 is inserted further into bore 72 until its enlarged head 82 is securely seated in the mouth of bore 72. The remote end of pin 74 passes through bores 78,79 to retain bar 62 in place in recess 71 and serves as the pivotal axle for bar 62. The inner walls of slide 14 retain pin 74 in bore 72.

It will be observed that the angular relationship between slot 75 and recess 77 applies the torsional force exerted by spring 73 to urge the head 63 on the free end of bar 62 downwardly.

As best seen in FIGS. 4 and 5, bar 62 is positioned to bear on the transverse limb 41 at the free rear end of trigger bar 34 and, unrestrained, under the influence of spring 73, forces trigger bar 34 downwardly so that trigger bar sear 42 is out of registry with firing pin sear 43. In this condition movement of trigger 32 and trigger bar 34 has no effect on firing pin 21, and the weapon is incapable of being fired, either intentionally or through inadvertance or accident.

When a magazine 83 is inserted into its receiver in handle 52, its inwardly curved lip 84 bears on the lower edge of bar 62 and maintains bar 62 in the position shown in FIGS. 1 and 2, allowing torsion spring 36 to rotate trigger bar 34 and thereby bring sear 42 into registry with sear 43, thus rendering the weapon operable.

As mentioned in my previous patent, when the last round in magazine 83 is fired, rotatably mounted slide lock bar 85 is rotated upwardly by the thrust of toe 91 of follower 92 against ear 93 and engages a recess in the lower edge of slide 14 to retain the slide open until manually released.

It will be apparent that the magazine safety and extractor of the subject invention may take alternative form. By way of example, instead of an elongated lever arm 62, the invention may be embodied in a rotatably mounted spring-biased cam positioned to bear on trigger bar 34 and adapted to be rotated out of contact with the trigger bar by some portion of the magazine when the latter is inserted in the receiver. Likewise, although not so described, the magazine safety and extractor may be adapted for translational rather than rotational motion.

The invention is not intended to be limited to the specific form of the embodiment shown, which is presented for illustrative purposes only. To the contrary, it contemplates all of the variations and modifications coming within the scope of the claims.

What is claimed is:

1. A magazine safety for a semi-automatic double action firearm having a magazine receiver, a cartridge magazine removeably fitted therein, and a cartridge extractor and wherein a firing pin is cocked and released for firing by a trigger bar pivotably connected to a trigger and resiliently urged into releasable engagement with said firing pin, said magazine safety comprising:

camming means comprising an elongated arm pivotably attached at one of its ends to the frame of said firearm and engaging said trigger bar at a point intermediate the ends of said arm for movement of said trigger bar out of engagement with said firing pin;

resilient means operatively connected between said frame and said camming means and rotating said camming means about its axis of rotation thereby holding said trigger normally out of engagement with said firing pin; and restraining means comprising a lip positioned on said magazine to engage the end of said arm remote from its said attached end and thereby restrain said camming means from disengaging said trigger bar and said firing pin, when said magazine is seated in its operational position in said magazine receiver.

2. A magazine safety as defined by claim 1 wherein said camming means is positioned in the path followed by a cartridge extracted from the firing chamber of said firearm by said extractor, and in cooperation with said extractor ejects said cartridge from said firearm.

3. A magazine safety as defined by claim 1 wherein:

said lip holds said arm in alignment with the path followed by a cartridge extracted from the firing chamber of said firearm by the extractor of said firearm when said magazine is seated in its operational position in said magazine receiver; and said arm is adapted in cooperation with said extractor to eject said cartridge from said firearm.

4. A magazine safety as defined by claim 3 wherein:

said arm is rotatably mounted to said frame by means of a pin passing transversely through said frame and said arm; and said resilient means comprise a torsion spring mounted on said pin and having one of its legs anchored to said frame and the other of its legs anchored to said arm.

5. In combination with a semi-automatic double-action firearm comprising a barrel secured to a frame and containing a firing chamber, a slide mounted to said frame for sliding motion axial of said barrel, a trigger pivotably mounted to said frame, a firing pin disposed within said frame for motion axial of said barrel and having a firing pin sear extending therefrom, a compression spring positioned between said frame and said firing pin, an elongated trigger bar having one of its ends pivotably attached to said trigger and a trigger bar sear on its other end adapted for releasable engagement with said firing pin sear, and having a lobe formed thereon intermediate its said ends, a rail mounted to said frame extending longitudinally of said barrel, resilient means acting on said trigger bar urging said lobe thereof into releasable sliding contact with said rail and urging said trigger bar sear into engagement with said firing pin sear, a magazine for cartridges, and a magazine receiver in said frame adapted to receive and releasably retain said magazine in a seated position, wherein said cartridges are fed into said firing chamber by operation of said slide, a magazine safety comprising:

camming means operatively mounted to said frame and effectively engaging said trigger bar for movement of said trigger bar sear out of engagement with said firing pin sear;

resilient means operatively connected between said frame and said camming means and urging said camming means to hold said trigger bar sear normally out of engagement with said firing pin sear; and restraining means associated with said magazine restraining said camming means from disengaging said trigger bar sear and said firing pin sear when said magazine is in said seated position in said magazine receiver.

6. The combination defined by claim 5 wherein:

said camming means comprise a cam rotatably mounted to said frame; and said resilient means comprises a spring adapted to rotate said cam about its axis of rotation, thereby urging said trigger bar sear out of engagement with said firing pin sear.

7. The combination defined by claim 6 wherein:

said cam comprises an elongated arm pivotably attached at one of its ends to said frame and positioned to engage said trigger bar at a point intermediate the ends of said arm; and said restraining means comprises a lip formed on said magazine and engaging the end of said arm remote from its said attached end when said magazine is in said seated position in said magazine receiver.

8. The combination defined by claim 7 wherein:

said lip holds said arm in alignment with the path followed by a cartridge extracted from the firing chamber of said firearm by the extractor of said firearm when said magazine is in said seated position in said magazine receiver; and said arm is adapted in cooperation with said extractor to eject said cartridge from said firearm.

9. The combination defined by claim 8 wherein:

said arm is rotatably mounted to said frame by means of a pin passing transversely through said frame and said arm; and said resilient means comprises a torsion spring mounted on said pin and having one of its legs anchored to said frame and the other of its legs anchored to said arm.

* * * * *